United States Patent [19]

Jugle

[11] Patent Number: 4,971,882

[45] Date of Patent: Nov. 20, 1990

[54] TONER AND DEVELOPER COMPOSITIONS WITH WAXES AND CHARGE ENHANCING ADDITIVES

[75] Inventor: Don B. Jugle, Penfield, N.Y.

[73] Assignee: Xerox Corporation, Stamford, Conn.

[21] Appl. No.: 288,318

[22] Filed: Dec. 22, 1988

[51] Int. Cl.[5] ..... G03G 9/097

[52] U.S. Cl. ..... 430/110; 430/126

[58] Field of Search ..... 430/106, 108, 904, 110

[56] References Cited

U.S. PATENT DOCUMENTS

| | | | |
|---|---|---|---|
| 3,983,045 | 9/1976 | Jugle et al. | 430/110 |
| 4,251,616 | 2/1981 | Hendriks | 430/107 |
| 4,298,672 | 11/1981 | Lu | 430/108 |
| 4,314,017 | 2/1982 | Takahashi et al. | 430/109 |
| 4,367,275 | 1/1983 | Aoki et al. | 430/99 |
| 4,460,672 | 7/1984 | Gruber et al. | 430/110 |
| 4,556,624 | 12/1985 | Gruber et al. | 430/110 |
| 4,604,338 | 8/1986 | Gruber et al. | 430/110 |
| 4,681,829 | 7/1987 | Grushkin | 430/111 |
| 4,849,316 | 7/1989 | Kawaski et al. | 430/110 |
| 4,859,550 | 8/1989 | Gruber et al. | 430/110 |
| 4,883,736 | 11/1989 | Hoffend et al. | 430/110 |

FOREIGN PATENT DOCUMENTS

| | | | |
|---|---|---|---|
| 54-101328 | 8/1979 | Japan | 430/111 |
| 57-84460 | 5/1982 | Japan | 430/110 |

OTHER PUBLICATIONS

"Unilin TM Alcohols", Petrolite Specialty Polymers Group brochure.

*Primary Examiner*—Roland E. Martin

*Attorney, Agent, or Firm*—E. O Palazzo

[57] ABSTRACT

A toner composition comprised of resin particles, pigment particles, charge enhancing additive, and a mixture of a charge enhancing additive and a wax component comprised of an alkylene, or polymeric alcohol of the formula $$CH_3(CH_2)_nCH_2OH$$

wherein n is a number of from about 30 to about 300.

51 Claims, No Drawings

TONER AND DEVELOPER COMPOSITIONS WITH WAXES AND CHARGE ENHANCING ADDITIVES

BACKGROUND OF THE INVENTION

This invention is generally directed to toner and developer compositions, and more specifically the present invention is directed to toner compositions, including magnetic, single component, and colored toner compositions containing as additives waxes and charge enhancing additives. In one embodiment of the present invention, the toner compositions are comprised of resin particles, pigment particles, charge enhancing additives, low molecular weight waxes such as polypropylene and polyethylene, and waxes with hydroxyl functionality to which has been added charge control additives thereby enabling control of the electrical, such as the triboelectric charge of the wax. There is also provided in accordance with the present invention positively, or negatively charged toner compositions comprised of resin particles, pigment particles, charge enhancing additives, and preferably externally blended waxes illustrated therein especially waxes with hydroxyl functionality to which have been added charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, charge enhancing additives, and preferably externally blended waxes with hydroxyl functionality to which have been added or incorporated charge enhancing additives. The toner and developer compositions of the present invention are useful in electrophotographic printing and imaging systems, especially those processes wherein blade cleaning of the photoconductive member is accomplished. Moreover, the toner and developer compositions of the present invention enable images with substantially no micro-spots, or comets thereon; and these compositions possess stable and/or substantially uniform elecrical properties for extended time periods. Thus, with the toner and developer compositions of the present invention there is enabled substantial uniformity of the toner triboelectric charge; and the triboelectric charge of the wax selected is maintained at substantially the same tribolectric charge of the toner, or at a charge level and magnitude that will provide optimal performance in an imaging or printing system, including for example if it is intended that the wax be incorporated in the developed image, then the wax has the samme charge as the toner. However, when the wax is to be developed in the background image areas it should have a charge thereon which is near zero, or opposite in magnitude to that of the toner. The preferred location for the deposition of the wax depends on its intended use, for example, when present in the image it can act as a fusing and cleaning assist, and when present in the image background it can function as a cleaning assist, or a fusing assist if a pretransfer charging device is selected. Additionally, there is provided in accordance with the present invention toner compositions wherein waxes inclusive of the polymeric alcohols with charge additives are present therein as internal or preferably external additives. In addition, the present invention is directed to developer compositions comprised of the aforementioned toners, and carrier particles.

Moreover, the toner and developer compositions of the present invention enable the photoconductive imaging member present in an imaging apparatus to function for extended time periods, for example, up to 100,000 imaging cycles while simultaneously preventing the localized accumulation of undesirable toner debris thereon, which can encompass sufficient areas of the photoconductive members and/or to permit unwanted toner spots to be present on the final developed output copy. Further, the developer compositions of the present invention possess stable electrical properties for extended time periods, and with these compositions, for example, there is no substantial change in the selected triboelectrical charging values, and substantially no degradation in $A_t$ which is the product of the toner concentration + 1 multiplied by the triboelectric charging value.

Developer and toner compositions with certain waxes therein are known. For example, there are illustrated in U.K. Patent Publication No. 1,442,835, the disclosure of which is totally incorporated herein by reference, toner compositions containing resin particles, and polyalkylene compounds, such as polyethylene and polypropylene of a molecular weight of from about 1,500 to 6,000, reference page 3, line 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplsihed, reference Palmeriti et al. U.S. Pat. No. 3,635,704, issued Jan. 18, 1972, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43. There is no teaching, however, in any of these patents with respect to the toner compositions with modified waxes or treated waxes, that is waxes with charge additives, especially the specific modified polymeric hydroxy waxes selected for the invention of the present application in one embodiment. With the present invention as contrasted to the prior art, for example, the charging characteristic of the waxes selected can be preselected, that is the specific charge thereon, and the magnitude thereof can be controlled, for example, the charge on the wax can be equal to greater, or less than the toner charge depending on its intended end use in the xerographic process. Typically, such waxes are added to enhance the performance of cleaning subsystems in xerographic devices by assuring that the photoreceptor is free of toner debris.

Moreover, the toner and developer compositions of the '045 patent do not possess many of the advantages as illustrated herein with respect to the toner and developer compositions with the polymeric alcohol waxes therein, that is for example the developer compositions of the '045 patent do not possess stable electrical properties in several imaging apparatuses, and with these compositions there is degradation in $A_t$ with extended imaging impressions, that is exceeding, for example, 100,000 developed images; nor, for example, does the incorporation of metal salts or metal salts of fatty acids such as zinc stearate or the addition of colloidal silicas, or mixtures thereof enable the elimination of toner spots on the final image copy with toner compositions, a disadvantage alleviated with the toner and developer compositions of the present application. Moreover, alkylenes and the polymeric alcohol waxes with charge enhancing additives selected for the compositions of the present invention possess the other advantages illustrated herein.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45, which waxes are substantially different in their properties and characteristics than the polymeric alcohol waxes selected for the toner and developer compositions of the present invention; and moreover, the toner compositions of the present invention with the waxes illustrated herein especially the polymeric alcohol additives possess advantages, such as elimination of toner spotting not achievable with the toner and developer compositions of the '275 patent and controlled preselected charges for the wax particles selected.

Other references of interest include U.S. Pat. Nos. 4,072,521, which discloses the use of amides as toner additives; 4,073,649 and 4,076,641. Furthermore, references of background interest are U.S. Pat. Nos. 3.165,420; 3,236,776; 4,145,300; 4,271,249; 4,556,624; 4,557,991; and 4,604,338.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided collodidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. Other prior art disclosing positively charged toner compositions with charge enhancing additives include U.S. Pat. Nos. 3,944,493; 4,007,293; 4,079,014; and 4.394,430. Toner compositions with negative charge enhancing additives are also known.

In U.S. Pat. No. 4,556,624 there are illustrated toner compositions wherein the toner polymer, pigment, certain waxes and a charge control agent are melt blended in bulk and then micronized, see for example column 7.

Illustrated in copending application U.S. Ser. No. 004,939/87, now U.S. Pat. No. 4,883,736, the disclosure of which is totally incorporated herein by reference are toner and developer compositions with linear polymeric alcohols comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300; and preferably of from about 30 to about 100, which alcohols are available from Petrolite Corporation. Particularly preferred polymeric alcohols include those wherein n represents a number of from about 30 to about 50. Therefore, the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions in various effective amounts as finely divided uniformly dispersed external additives. More specifically, the polymeric alcohols are present in an amount of from about 0.05 percent to about 20 percent by weight. Therefore, for example, as external additives the polymeric alcohols are present in an amount of from about 0.5 percent by weight to slightly less than about 5 percent by weight. The aforementioned alcohols are also selected for the invention of the present application, which alcohols, however, have added thereto charge enhancing additives as indicated herein.

The aforementioned, copending application also discloses the addition of charge control additives to the toner composition. With the invention of the present application, in one embodiment the waxes selected are first treated with charge enhancing additives and subsequently the toner and developer compositions are prepared thereby permitting, for example, the advantages illustrated herein including the preselection of charge on the wax, and selection of the charge present on the toner, which charge remains stable for extended time periods exceeding, for example, 250,000 imaging cycles. Generally, the aforesaid charge is from about a positive or negative 15 to about 35 microcoulombs per gram.

Although the above described toner and developer compositions are useful for their intended purposes, there is a need for improved compositions. More specifically, there is a need for toner compositions, including single component compositions which possess advantages not achievable with the prior art compositions. There is also a need for toner compositions with certain waxes that are particularly useful in electrostatic imaging processes wherein blade cleaning is utilized for the prevention of the deposition of unwanted toner particles on the photoreceptor surface; and wherein there results no undesirable toner spots on the images resulting. In addition, there is a need for toner and developer compositions that maintain their triboelectrical characteristics for extended time periods exceeding, for example, 100,000 developed images, and wherein the wax mixture possesses a triboelectric charge substantially equivalent to the toner compositions. Further, there is a need for toners that deposit in background regions of the formed image on the photoreceptor, thus a lower charge on the wax than on the toner is selected. In addition, there is a need for toner and developer compositions that simultaneously prevent toner spots, maintain stable electrical characteristics for intended time periods, and maintain the toner triboelectric charge at a uniform value. Furthermore, there is a need for single component toners and colored toners that possess many of the aforementioned characteristics. Also, there is a need for toner and developer compositions with certain toxicologically safe and economical waxes with charge enhancing additives incorporated therein, or on the surface thereof that allow the aforementioned advantages, and other advantages to be obtained.

SUMMARY OF THE INVENTION

It is an object of the present invention to provide toner and developer compositions which possess many of the advantages illustrated herein.

Another object of the present invention resides in the provision of toner and developer compositions with stable triboelectrical characteristics for extended time periods.

In another object of the present invention there are provided toner and developer compositions that enable the prevention of toner spots on documents generated in electrophotographic imaging systems while simultaneously maintaining the toner triboelectric charge on the wax additive selected substantially equivalent to the charge on the toner, or maintaining the charge at another desired level relative to that of the toner.

Moreover, another object of the present invention relates to the provision of toner and developer compositions with treated waxes permitting toner compositions and waxes with stable triboelectric values of from about a negative or positive 15 to about 35 microcoulombs per gram.

Also, in another object of the present invention there are provided toner and developer compositions wherein, for example, accumulations less than about 0.1 micrometer of the wax, such as the polymeric alcohols, results on the imaging member, for example, as determined by transmission electron microscopy (TEM) thereby avoiding any adverse effects on the electrical properties of the imaging member, and enabling images of high quality to be continuously reproduced.

Furthermore, in another object of the present invention there are provided positively or negatively charged, that is where charge additives such as Bontron E88, TRH, available from Hopdogaya Chemical, aluminum nicontinate, aluminum palamate, potassium tetraphenyl borate, and the like are selected, toner and developer compositions useful for the development of images present on positively or negatively charged imaging members.

Additionally, in yet another object of the present invention there are provided toner and developer compositions with certain waxes therein which waxes contain thereon charge enhancing additives, that enable images of excellent quality inclusive of acceptable resolutions with no toner spots on the photoreceptor, and that possess other advantages as illustrated herein.

In another object of the present invention there are provided positively or negatively charged toner compositions with certain waxes thereon, which waxes contain charge enhancing additives, which compositions are useful for causing the development of electrostatic latent images, including color images.

In yet another object of the present invention there are provided single component toner compositions with certain treated waxes thereon.

In a further object of the present invention there are provided colored toner and developer compositions with certain treated waxes thereon.

Additionally, in still another object of the present invention there are provided methods for the development of images, including colored images with no spots thereon in electrostatographic imaging systems.

These and other objects of the present invention are accomplished by providing developer compositions and toner compositions comprised of resin particles, pigment particles, and treated waxes with charge enhancing additives. More specifically, the present invention is directed to toner compositions comprised of resin particles, pigment particles inclusive of magnetites, charge enhancing additives, and a mixture of alkylene waxes, or waxes with hydroxyl functionality, which waxes contain therein or are treated with charge enhancing additives. In one embodiment of the present invention there are provided toner compositions comprised of resin particles, pigment particles, charge enhancing additives, and certain polymeric alcohol waxes containing therein charge enhancing additives which waxes are available from Petrolite Corporation. Furthermore, there are provided in accordance with the present invention positively charged toner compositions comprised of resin particles, pigment particles, charge enhancing additives, and preferably as external components, polymeric alcohol waxes containing therein charge enhancing additives. Another embodiment of the present invention is directed to developer compositions comrpised of the aforementioned toners; and carrier particles.

Another embodiment of the present invention is directed to a toner composition comprised of resin particles, pigment particles, a charge enhancing additive, and mixture comprised of a wax component comprised of alkylenes, such as polypropylene and polyethylene, or polymeric alcohols of the formula $$CH_3(CH_2)_nCH_2OH$$

wherein n is a number of from about 30 to about 300, and a charge enhancing additive. Also, in a further embodiment, the present invention is directed to a toner composition comprised of resin, pigment charge enhancing additive, and a mixture of a charge enhancing additive and a wax component, and a developer composition thereof.

Further, in another embodiment of the present invention there is provided a process for the preparation of toner compositions with stable electrical characteristics which comprises melt mixing the wax component and a charge control additive, micronizing, and fracturing to enable the charge enhancing additive to be present on the surface of the wax incorporated therein, or both thereby controlling the electrical charge on the wax, that is the charge on the wax is of the correct sign, positive or negative, depending on its use and magnitude to, for example, enable suitable image and/or background development, and subsequently mixing with the aforementioned formed product resin, pigment particles, and charge additives. Additionally, there is provided in accordance with the present invention a method for obtaining images which comprises generating an electrostatic latent image on a photoconductive imaging member, subsequently effecting development of this image with a toner and developer composition illustrated herein, thereafter transferring the image to a permanent substrate, and optionally permanently affixing the image thereto.

In addition, in accordance with other embodiments of the present invention there are provided developer compositions comprised of toner compositions containing resin particles, particularly styrene butadiene resins, pigment particles such as magnetites, carbon blacks or mixtures thereof, charge additives, polymeric hydroxy waxes available from Petrolite as detailed hereinafter, which waxes are incorporated into the toner compositions as external components; and wherein said waxes are treated with charge enhancing additives, particularly, for example, distearyl dimethyl ammonium methyl sulfate, reference U.S. Pat. No. 4,560,635, the disclosure of which is totally incorporated herein by reference; and carrier particles. As preferred carrier components for the aforementioned compositions, there are selected steel or ferrite materials, particularly with a polymeric coating thereover including the coatings as illustrated in U.S. Ser. Nos. 136,792/87, now U.S. Pat. No. 4,935,326 and 136,791/87, now U.S. Pat. No. 4,937,166, the disclosures of which are totally incorporated herein by reference. One particularly preferred coating illustrated in the aforementioned copending applications is comprised of a copolymer of vinyl chloride and trifluorochloroethylene with conductive substances dispersed in the polymeric coating inclusive, of, for example, carbon black. One embodiment disclosed in the aforementioned copending applications is a developer composition comprised of styrene butadiene copolymer resin particles, pigment particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers.

Illustrative examples of suitable toner resins selected for the toner and developer compositions of the present invention, and present in various effective amounts such as, for example, from about 70 percent by weight to about 95 percent by weight, include polyesters, polyamides, epoxy resins, polyurethanes, polyolefins, vinyl resins and polymeric esterification products of a dicarboxylic acid and a diol comprising a diphenol. Various suitable vinyl resins may be selected as the toner resin including homopolymes or copolymers of two or more vinyl monomers. Typical vinyl monomeric components subsequently polymerized include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole, N-vinyl pyrrolidone, pliolites, olefin polymers, styrene butadiene copolymers, especially styrene butadiene copolymers prepared by a suspension polymerization process, reference U.S. Pat. No. 4,558,108, the disclosure of which is totally incorporated herein by reference; and mixtures thereof.

As one preferred toner resin there can be selected the esterification products of a dicarboxylic acid and a diol comprising a diphenol, which components are illustrated in U.S. Pat. No. 3,590,000, the disclosure of which is totally incorporated herein by reference. Other preferred toner resins include styrene/methacrylate copolymers, styrene/acrylate copolymers, and styrene/butadiene copolymers, especially those as illustrated in the aforementioned '108 patent; and styrene butadiene resins with high styrene content, that is exceeding from about 80 to 85 percent by weight of styrene, which resins are available as Pliolites® presently referred to as Pliotones® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Numerous well known suitable pigments can be selected as the colorant for the toner particles including, for example, carbon black, especially Regal 330®, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 3 percent by weight to about 50 percent by weight, and preferably from about 3 to about 20, based on the total weight of the toner composition, however, lesser or greater amounts of pigment particles can be selected providing the objectives of the present invention are achieved.

When the pigment particles are comprised of magnetites, including those commercially available as Mapico Black, they are present in the toner composition in an amount of from about 10 percent by weight to about 75 percent by weight, and preferably in an amount of from about 10 percent by weight to about 40 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments are magnetities as they enable, for example with the other toner components, images with no toner spots for extended time periods exceeding the development of 100,000 images, which corresponds to about 400,000 imaging cycles for a panel containing four imaging members.

Also embraced within the scope of the present invention are colored toner compositions containing as pigments or colorants magenta, cyan, and/or yellow particles, as well as mixtures thereof, red, blue, brown, and the like. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, red, blue, green, brown, lithol scarlett, and the like. These pigments are generally present in the toner composition in an amount of from about 2 weight percent to about 15 weight percent based on the weight of the toner resin particles.

Illustrative examples of charge enhancing additives that are selected for the toner and blended or incorporated with the polymeric alcohols, or other waxes, and present in various effective amounts, such as, for example, from about 0.1 to about 20, and preferably from about 0.1 to about 5 percent by weight, include alkyl pyridinium halides, such as cetyl pyridinium chloride, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; TRH, potassium tetraphenyl borate; and other known similar charge enhancing additives providing the objectives of the present invention are accomplished; and the like. Usually the charge additives are melt mixed into the aforesaid waxy components by known methods including extrusion, the use of Banbury rubber mills, and the like. Of importance with respect to the present invention is the blending of the treated and micronized waxes with the formed toner in particulate form to permit a mixture thereof.

With further respect to the toner and developer compositions of the present invention, an important component present therein that enables many of the advantages illustrated herein to be obtained is the wax mixture wherein the wax includes polyethylene, polypropylene, other specific alkylenes available as 660P, and linear polymeric alcohol available as Unilins ® comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 700, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and can be added as finely divided uniformly dispersed external additives. More specifically, the modified or treated with charge additive polymeric alcohols or other wax mixtures are present in an amount of from about 0.05 percent to about 20 percent by weight. Therefore, for example, as external additives the treated polymeric alcohols or alkylenes are present in an amount of from about 0.05 percent by weight to slightly less than about 5 percent by weight. When the wax mixture is present as an external additive, the toner composition is initially formulated comprised of, for example, resin particles and pigment particles; and subsequently there is added thereto a mixture of charge additive and finely divided modified polymeric alcohols, or alkylenes.

Although it is not desirable to be limited by theory, it is believed that the aforementioned linear polymeric alcohols possess very narrow polydispersity, that is the ratio of $M_w/M_n$ is equal to or less than about 1:1 in one preferred embodiment; and moreover, these alcohols possess high crystallinity with a density of about 0.985. By high crystallinity is meant that the linear polymeric alcohol molecular chains possess a high degree of molecular order in their solid state molecular structure, and also possess zero to very few defects in this ordered molecular structure, reference for example the text *Macromolecule Structure and Properties*, Vol. 1, authored by Hans Georg Elias (1984), particularly Chapter 5, pages 151 to 154. Accordingly, it is believed that the polymeric waxes selected are substantially different than the waxes illustrated in the prior art primarily because of the advantages achieved with the toner and developer compositions containing these waxes, which advantages are not obtainable with the wax toner compositions of the prior art; and moreover, the specific waxes of the present invention encompassed by the formula illustrated herein possess properties that are unique for polymeric waxes inclusive of substantially complete saturation, high linearity, crystallinity, narrow molecular weight distributions, and primary alcohol functionality. In addition, the primary alcohol waxes of the present invention possess the appropriate hardness and toughness properties enabling the resulting toner and developer compositions to be readily attritable to fine particle sizes of less than, for example, about 15 micrometers average diameter.

The aforementioned modified or treated waxes, that is a mixture comprised of a wax with a charge control additive preferably incorporated therein, can possess a wide range of triboelectric values of either a positive or negative polarity. For a negative polarity, negative charge additives such as TRH, orthophenycarboxylic acids, potassium tetraphenyl borate, and the like as indicated herein are selected. Generally, the triboelectric wax charge is from about a positive or negative 15 to about 35 and preferably from about 20 to about 25 microcoulombs per gram for an extended number of imaging cycles. The aforesaid modified or treated waxes, which can be transparent, can deposit as background (a wax with a near zero charge) as indicated herein or on the image. Also, mixture contains effective amounts of wax and charge additive as illustrated herein. For example, the mixture can contain from about 0.1 to about 20, and preferably 0.1 to 5 weight percent of charge additive, and the like providing the objectives of the present invention are achieved.

With further respect to the toner and developer compositions of the present invention, by spots as mentioned herein is meant a spot of toner on the imaging member. The aforementioned spot can retain electrostatic charge independent of the exposure of the imaging member permitting it to undesirably attract toner particles which are then transferred to the final image copy yielding an unwanted spot or an accumulation of spots. Accordingly, spots are undesirable, particularly when more than one spot results on the final image, which is usually the situation with the waxes of the prior art wherein, for example, hundreds of spots are formulated with a length of from about 4 to about 5 millimeters and a width of 0.5 millimeter as eventually these spots will result in images of very poor resolution, unwanted background, and other undesirable copy quality characteristics including unacceptable edge definition.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, including copper zinc ferrites, and other known ferrite carriers such as those with magnesium, copper, and zinc, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922, now abandoned relating to developer compositions with certain carrier particles, the disclosure of which is totally incorporated herein by reference. More specifically, there are illustrated in the aforementioned application carrier particles comprised of a core with a coating thereover of vinyl polymers, or vinyl homopolymers. Examples of specific carriers illustrated in the aforementioned application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings such as those illustrated in U.S. Pat. No. 4,233,387, the disclosure of which is totally incorporated herein by reference. There can also be selected as carriers components comprised of a core with a double polymer coating thereover reference U.S. Ser. Nos. 136,791, now U.S. Pat. Nos. 4,937,166 and 136,792, now U.S. Pat. No. 4,935,326, the disclosures of which are totally incorporated herein by reference. More specifically, there is detailed in these copending applications a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer, which first and second polymers are not in close proximity in the triboelectric series; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles. Coating weight can vary. Generally, however, known coating weights are selected such as, for example, from about 0.1 to about 5 weight percent. Other coating weights can be selected provided the objectives of the present invention are achieved.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner compositions of the present invention can be prepared by a number of known methods, including mechanical blending and melt blending the toner resin particles, pigment particles or colorants, charge additives, and thereafter adding to the formed toner a mixture of charge additives and the polymeric alcohols or other waxes, followed by mechanical attrition. Other methods include those well known in the art such as spray drying, mechanical dispersion, extrusion, melt dispersion, dispersion polymerization, and suspension polymerization. In one dispersion polymerization method, a solvent dispersion of the resin particles, the pigment particles, and charge additives are mixed to form a toner, and spray dried; and there is added thereto a mixture of the treated polymeric alcohols or other waxes. With further respect to the present invention, the treated polymeric alcohols, or alkylenes, are preferably added as external additives, that is the toner compositions are first prepared, which compositions are comprised of, for example, resin particles, pigment particles and the other components indicated herein such as charge enhancing additives; thereafter cooling, for example, to room temperature the aforesaid melt mixed component. Thereafter, the final toner is formulated by comminuting the components, for example, in an alpine fluid grinder, which final toner usually has a particle average volume diameter of from about 5 to about 20 microns. Subsequently, the formed particulate toner and the particulate treated wax (mixture of wax and charge additive) are mechanically mixed to enable a uniform mixture of two different materials comprised in a typical composition of a mixture of 99.8 parts toner and 0.2 parts treated wax, however, other amounts can be selected such as from about 99.95 to 95 parts toner and 0.05 to 5 parts of treated wax, respectively, and the like.

With further respect to the present invention and the advantages illustrated herein, they are preferably obtained by preparing the toner compositions in a manner that the treated wax is provided as an external component especially in an amount of from about 0.05 to about 5 percent by weight. Moreover, the resulting toner particles with treated wax thereon are generally of an average volume diameter of from about 1 to about 50 micrometers.

In addition, the toner and developer compositions of the present invention may be selected for use in developing images in electrophotographic imaging systems containing therein, for example, conventional photoreceptors, such as selenium and selenium alloys, such as selenium arsenic, selenium tellurium, selenium arsenic tellurium, and the like. Also useful, especially wherein there are selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Moreover, there can be selected as photoconductors hydrogenated amorphous silicon, and as photogenerating pigments squaraines, perylenes, and the like.

The toner and developer compositions of the present invention are particularly useful with electrophotographic imaging apparatuses containing a development zone situated between a charge transporting means and a metering charging means, which apparatus is illustrated in U.S. Pat. Nos. 4,394,429 and 4,368,970, the disclosures of which are totally incorporated herein by reference. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means, a transporting means, a development zone situated between the imaging means and the transporting means; the development zone containing therein electrically insulating magnetic carrier particles, means for causing the flexible imaging means to move at a speed of from about 5 cm/sec (centimeters/second) to about 50 cm/sec, means for causing the transporting means to move at a speed of from about 6 cm/sec to about 100 cm/sec, the means for imaging and the means for transporting moving at different speeds; and the means for imaging and the means for transporting having a distance therebetween of from about 0.05 millimeter to about 1.5 millimeters.

One preferred developer composition of the present invention is comprised of a toner composition with 80 weight percent of styrene butadiene resin particles (91/9), about 16 percent by weight of magnetite, about 3 percent by weight of carbon black, about 1.0 percent by weight of the charge enhancing additive distearyl dimethyl ammonium methyl sulfate, and as an external additive a mixture comprised of about 0.30 percent by weight of the polymeric alcohol wax illustrated herein with a number average molecular weight of about 700, which wax has been blended with about 1.0 percent by weight of the charge enhancing additive distearyl dimethyl ammonium methyl sulfate, and carrier particles comprised of a steel core with a coating of 1.25 weight percent thereover of a polymer of, for example, a vinyl chloride/trichlorofluoroethylene copolymer available as FPC 461, which coating has dispersed therein carbon black particles.

The toner compositions of the present invention may also contain additives such as low molecular weight waxes, colloidal silicas, metal salts, metal salts of fatty acids, or mixtures thereof, reference for example British Patent Publication No. 1,442,835, the disclosure of which has been totally incorporated herein by reference. More specifically, on page 2 of the '835 publication it is indicated that the toner contains at least one polyalkylene compound selected from polyethylene and polypropylene. Also, note the reference on page 3 of the present application to U.S. Pat. No. 3,655,374 wherein it is indicated that many patents disclose the use of metal salts of fatty acids for toner compositions such as U.S. Pat. No. 3,655,374, and it is also known that the toner compositions with metal salts of fatty acids can be selected for electrostatographic imaging methods wherein blade cleaning of the photoreceptor is accomplished, reference U.S. Pat. No. 3,635,704, the disclosure of which was totally incorporated herein by reference.

The following examples are being submitted to further define various species of the present invention. These examples are intended to illustrate and not limit the scope of the present invention. Also, parts and percentages are by weight unless otherwise indicated. In these examples, the wax was untreated or treated by blending it with about 0.5 percent of charge enhancing additive, cooling, and then melt mixing in an extruder at a temperature sufficient to melt mix, that is for example 80° C. The cooled extrudate was then mechanically crushed and comminuted in an air jet micronizer to enable particles with an average volume particle diameter of about from 8 to 12 microns, and preferably 9 microns. There results a treated wax that is homogeneous with the charge additive uniformly distributed throughout the wax particles. The resulting treated wax was then blended with carrier particles and the triboelectric charge thereon determined by the standard Faraday cage apparatus. The triboelectric charges for the treated wax were as follows against the carrier indicated and the concentration specified.

TABLE I

| Wax Type and CCA Additive Conc. | Tribo* at 5 Min. Paint Shake (uc/gm) | Wax to Carrier* Ratio |
|---|---|---|
| Unilin 700 ® | −6.80 | 0.0258 |
| Unilin 700 ® and 0.5% KTPB | −18.50 | 0.0260 |
| Unilin 700 ® and 0.5% CPC | −6.10 | 0.0252 |
| Unilin 700 ® and 1.0% DDAMS | −13.90 | 0.0254 |
| 660P Wax (Polypropylene available from Sanyo Chemical) | −1.53 | 0.0264 |
| 660P Wax and 1% DDAMS | 0.59 | 0.0264 |
| 660P Wax and 1% Bontron E88 | 34.90 | 0.0215 |

*Steel core with a coating, 1.25 weight percent of FPC 461
KTPB - potassium tetraphenyl borate
CCA - charge control additive
CPC - cetyl pyridinium chloride
DDAMS - distearyl dimethyl ammonium methyl sulfate

EXAMPLE I

There was prepared by melt blending, followed by mechanical attrition, a toner composition comprised of 80 percent by weight of a styrene butadiene resin with 91 percent by weight of styrene and 9 percent by weight of butadiene, 3 percent by weight of Regal 330 ® carbon black, 16 percent by weight of Mapico Black, and 1 percent by weight of the charge enhancing additive potassium tetraphenyl borate. There was added to the formed toner as an external additive mixture by mixing therewith 0.5 percent of the linear polymeric alcohol Unilin 700 ®, available from Petrolite, of the formula as illustrated herein with a number average molecular weight of about 700, that is where n is the number 48, and an average particle diameter of 8 micrometers, which alcohol was treated with the charge additive potassium tetraphenyl borate, 0.5 weight percent. Thereafter, the resulting toner was subjected to micronization and classification resulting in toner particles with an average volume diameter of about 10.5 microns. Subsequently, there was prepared a developer composition by admixing the aforementioned formulated toner composition at a 4.5 percent toner concentration, that is 4.5 parts by weight of toner per 100 parts by weight of carrier, which carrier was comprised of a steel core with a coating thereover, 1.25 weight percent, of a vinyl chloride trichlorofluoroethylene copolymer with 10 weight percent of carbon black particles dispersed therein. The aforementioned treated wax charge additive mixture had a triboelectric charge thereon as determined by the known Faraday Cage method of −18.5 microcoulombs per gram, which was the same charge present on the toner composition.

Thereafter, it is believed that the formulated developer composition can be incorporated into an electrostatographic imaging device with a toner transporting means, a toner metering charging means, and a development zone as illustrated in U.S. Pat. No. 4,394,429, the disclosure of which is totally incorporated herein by reference, and wherein the imaging member is comprised of an aluminum supporting substrate, a photogenerating layer of trigonal selenium, and a charge transport layer thereover of the aryl amine N,N'-diphenyl-N,N'-bis(3-methylphenyl) 1,1'-biphenyl-4,4'-diamine, 50 percent by weight, dispersed in 50 percent by weight of the polycarbonate resin available as Makrolon ®, reference U.S. Pat. No. 4,265,990, the disclosure of which is totally incorporated herein by reference, and it is believed that images of high quality with no background deposits will be obtained.

Also, it is believed that here can be obtained in the aforementioned imaging fixture images of acceptable quality, substantially no toner spots, and where the triboelectric charge on the toner and the alcohol remained stable at +25 microcoulombs per gram when the charge additive distearyl dimethyl ammonium methyl sulfate is substituted for the potassium tetraphenyl borate in both the toner and the Unilin ® alcohol for about 100,000 imaging cycles.

EXAMPLE II

A toner and developer composition can be prepared by repeating the procedure of Example I with the exception that there can be selected 0.2 percent by weight of the treated polymeric alcohol, available from Petrolite Corporation, of the formula as illustrated herein with a number average molecular weight of about 425. It is believed that substantially similar results will be obtained.

EXAMPLE III

A toner and developer composition can be prepared by repeating the procedure of Example II with the exception that there is selected 0.05 percent by weight of the polymeric alcohol, and subsequent to imaging in the electrostatographic imaging device no toner spots will be observed on the imaging member or the developed images until about 90,000 developed images.

With respect to image quality, a number of different imaging characteristics are believed to be associated therewith, thus high image quality includes, but is not limited to, for example, the absence of substantially no background deposits on the resulting image copy, acceptable edge definition, excellent solid area density, line width, and halftone reproduction; and further, the images should be nongrainy as determined by visual observation. In addition, the toner compositions of the present invention possess other advantages as illustrated herein, especially maintaining the triboelectric charge on the treated polymeric alcohol substantially identical to the toner, for example, from about a positive or negative 15 to about 35 microcoulumbs per gram.

Other modifications of the present invention may occur to those skilled in the art subsequent to a review of the present application. The aforementioned modifications, including equivalents thereof are intended to be included within the scope of the present invention.

What is claimed is:

1. A toner composition comprised of resin particles, pigment particles, charge enhancing additive, and a mixture of a charge enhancing additive and a wax component comprised of a polymeric alcohol of the formula $CH_3(CH_2)_nCH_2OH$ wherein n is a number of from about 30 to about 300.

2. A toner composition in accordance with claim 1 wherein the triboelectric charge on the wax is equal to, greater than, or less than the triboelectric charge on the toner comprised of resin, pigment, and charge additive.

3. A toner composition in accordance with claim 1 containing surface additives.

4. A toner composition in accordance with claim 2 wherein the surface additives are colloidal silicas, metal salts, metal salts of fatty acids, or mixtures thereof.

5. A toner composition in accordance with claim 1 wherein the charge additive is incorporated into the wax, or present on the surface thereof in the mixture.

6. A toner composition in accordance with claim 1 wherein n is a number of from about 30 to about 50.

7. A toner composition in accordance with claim 1 wherein the polymeric alcohol wax has a number average molecular weight of from about 475 to about 1,400.

8. A toner composition in accordance with claim 1 wherein the wax mixture with charge additives is present as an external component.

9. A toner composition in accordance with claim 1 wherein the resin particles are selected from the group consisting of polyesters, styrene butadiene polymers, styrene acrylate polymers, and styrene methacrylate polymers.

10. A toner composition in accordance with claim 9 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

11. A toner composition in accordance with claim 1 wherein the pigment particles are carbon black, magnetite, or mixtures thereof.

12. A toner composition in accordance with claim 1 wherein the pigment particles are selected from the group consisting of magenta, cyan, yellow, and mixtures thereof.

13. A toner composition in accordance with claim 1 with a stable triboelectric charge of from about 15 to about 30 microcoulombs per gram.

14. A toner composition in accordance with claim 1 wherein the charge enhancing additive for the toner comprised of resin and pigment particles, and the mixture is independently selected from the group consisting of distearyl dimethyl ammonium methyl sulfate, cetyl pyridinium halides, stearyl phenethyl dimethyl ammonium tosylate, and potassium tetraphenyl borate.

15. A toner composition in accordance with claim 14 wherein the pigment particles are selected from the group consisting of magenta, cyan, yellow, mixtures thereof, carbon black, and magnetites.

16. A toner composition in accordance with claim 14 wherein the resin particles are comprised of components selected from polyesters, styrene butadiene copolymers, styrene acrylate copolymers, and styrene methacrylate copolymers.

17. A toner composition in accordance with claim 14 wherein the mixture of wax with a charge additive is present as an external component.

18. A developer composition comprised of the toner composition of claim 1, and carrier particles.

19. A developer composition comprised of the toner composition of claim 14, and carrier particles.

20. A developer composition in accordance with claim 18 wherein the carrier particles are comprised of a core with a polymeric coating thereover.

21. A developer composition in accordance with claim 19 wherein the carrier particles are comprised of a core with a polymeric coating thereover.

22. A developer composition in accordance with claim 18 wherein the carrier particles are comprised of a core selected from the group consisting of steel and ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

23. A developer composition in accordance with claim 19 wherein the carrier particles are comprised of a core selected from the group consisting of steel and ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

24. A developer composition in accordance with claim 18 wherein the polymeric alcohol wax selected for the toner has a number average molecular weight of from about 475 to about 1,400.

25. A developer composition in accordance with claim 19 wherein the polymeric alcohol wax selected for the toner has a molecular weight average of from about 475 to about 1,400.

26. A developer composition in accordance with claim 18 wherein the resin particles are selected from the group consisting of polyesters, styrene butadiene polymers, styrene acrylate polymers, and styrene methacrylate polymers.

27. A developer composition in accordance with claim 26 wherein there is selected a suspension polymerized styrene butadiene.

28. A developer composition in accordance with claim 18 wherein the pigment particles for the toner are comprised of a carbon black, magnetites, or mixtures thereof.

29. A developer composition in accordance with claim 28 wherein the pigment mixture contains from about 6 percent by weight to about 70 percent by weight of magnetite, and from about 2 percent by weight to about 15 percent by weight of carbon black.

30. A developer composition in accordance with claim 18 wherein the pigment particles for the toner are selected from the group consisting of magenta, cyan, yellow, and mixtures thereof.

31. A method for obtaining images which comprises generating an electrostatic latent image on a photoconductive imaging member, subsequently effecting development of this image with the toner composition of claim 1, thereafter transferring the image to a permanent substrate, and optionally permanently affixing the image thereto.

32. A method for obtaining images which comprises generating an electrostatic latent image on a photoconductive imaging member, subsequently effecting development of this image with the toner composition of claim 14, thereafter transferring the image to a permanent substrate, and optionally permanently affixing the image thereto.

33. A method for obtaining images which comprises generating an electrostatic latent image on a photoconductive imaging member, subsequently effecting development of this image with the developer composition of claim 20, thereafter transferring the image to a permanent substrate, and optionally permanently affixing the image thereto.

34. A method of imaging in accordance with claim 31 wherein a blade means is selected for accomplishing cleaning of the imaging member.

35. A method of imaging in accordance with claim 31 wherein the charge on the wax mixture is controlled enabling development in the image areas, and or background areas.

36. A method of imaging in accordance with claim 31 wherein there results images with no toner spots thereon, and wherein the triboelectric charge on the toner and the treated wax are substantially equivalent.

37. A method of imaging in accordance with claim 32 wherein there results images with no toner spots thereon, and wherein the triboelectric charge on the toner and the treated wax are substantially equivalent.

38. A toner composition comprised of resin particles, pigment particles, charge enhancing additives and a mixture comprised of a charge enhancing additive and a wax component comprised of a polymeric alcohol of the formula $$CH_3(CH_2)_nCH_2OH$$

wherein n represents the number of repeating units.

39. A toner composition in accordance with claim 38 wherein the wax with charge additive is present as an external component.

40. A toner composition in accordance with claim 38 wherein the charge enhancing additive is incorporated into the wax, or present on the surface thereof in the mixture.

41. A toner composition in accordance with claim 40 wherein the charge enhancing additive wax mixture is present as an external additive in an amount of from about 0.5 to about 5 weight percent.

42. A toner composition in accordance with claim 38 wherein the charge enhancing additive for the wax and the toner comprised of resin and pigment particles is independently selected from the group consisting of distearyl dimethyl ammonium methyl sulfate, cetyl pyridinium halides, stearyl phenethyl dimethyl ammonium tosylate, and potassium tetraphenyl borate.

43. A developer composition comprised of the toner of claim 38 and carrier particles.

44. A toner composition comprised of resin, pigment, charge enhancing additive, and a mixture comprised of a charge enhancing additive and a wax component comprised of a polymeric alcohol of the formula $$CH(CH)CH\ OH$$

wherein n represents the number of repeating units.

45. A toner composition in accordance with claim 44 wherein n is a number of from about 30 to about 300.

46. A toner composition in accordance with claim 44 wherein the mixture is present as an external component.

47. A toner composition in accordance with claim 44 wherein the charge additive is incorporated into the wax, or present on the surface thereof in the mixture.

48. A developer composition comprised of the toner of claim 44 and carrier particles.

49. A developer composition in accordance with claim 48 wherein the carrier contains a polymeric coating.

50. A developer composition in accordance with claim 49 wherein the coating contains conductive particles.

51. A developer composition in accordance with claim 49 wherein the conductive particles are carbon black.

* * * * *